US005413752A

United States Patent [19]

Kissinger et al.

[11] Patent Number: 5,413,752

[45] Date of Patent: May 9, 1995

[54] METHOD FOR MAKING FATIGUE CRACK GROWTH-RESISTANT NICKEL-BASE ARTICLE

[75] Inventors: Robert D. Kissinger, Reading; Michael E. Sauby, Cincinnati; Richard G. Menzies, Wyoming; Allen J. Paxson, Cincinnati, all of Ohio

[73] Assignee: General Electric Company, Cincinnati, Ohio

[21] Appl. No.: 957,113

[22] Filed: Oct. 7, 1992

[51] Int. Cl.[6] ..... B22F 3/00

[52] U.S. Cl. ..... 419/28; 419/14; 419/15; 419/55; 419/29; 419/38; 419/46; 419/47

[58] Field of Search ..... 148/675, 676, 677; 419/14, 15, 29, 38, 46, 47, 28

[56] References Cited

U.S. PATENT DOCUMENTS

| | | | |
|---|---|---|---|
| 3,406,555 | 10/1968 | Fuchs, Jr. | 72/377 |
| 3,457,066 | 7/1969 | Pohlman et al. | 75/171 |
| 3,519,419 | 7/1970 | Gibson et al. | 75/171 |
| 3,550,417 | 12/1970 | McMaster | 72/57 |
| 3,576,681 | 4/1971 | Barker et al. | 148/32 |
| 3,890,816 | 6/1975 | Allen et al. | 75/5 BA |
| 4,040,286 | 8/1977 | Abramowitz et al. | 72/377 |
| 4,719,080 | 1/1988 | Duhl et al. | 420/443 |
| 4,729,799 | 3/1988 | Henricks et al. | 148/13 |
| 4,740,354 | 4/1988 | Watanabe et al. | 420/455 |
| 4,769,087 | 9/1988 | Genereux et al. | 148/2 |
| 4,957,567 | 9/1990 | Krueger et al. | 148/12.7 |
| 5,009,704 | 4/1991 | Banik | 75/238 |
| 5,023,050 | 6/1991 | McKannan et al. | 420/448 |
| 5,047,093 | 8/1991 | Kimmerle et al. | 148/162 |
| 5,059,257 | 10/1991 | Wanner et al. | 148/12.3 |
| 5,061,324 | 10/1991 | Chang | 148/11.5 N |
| 5,080,734 | 1/1992 | Krueger et al. | 148/410 |
| 5,100,484 | 3/1992 | Wukusick et al. | 148/20.3 |
| 5,120,373 | 6/1992 | Miller et al. | 148/564 |
| 5,131,961 | 7/1992 | Sato et al. | 148/677 |
| 5,181,547 | 4/1992 | Tanaka et al. | 29/526.3 |
| 5,223,053 | 6/1993 | Cone et al. | 148/624 |
| 5,244,515 | 9/1993 | Miglin | 148/675 |
| 5,302,217 | 4/1994 | Gostic et al. | 148/675 |
| 5,306,570 | 4/1994 | Jackson et al. | 428/614 |
| 5,312,497 | 5/1994 | Mathey | 148/675 |

*Primary Examiner*—Donald P. Walsh
*Assistant Examiner*—Daniel Jenkins
*Attorney, Agent, or Firm*—Jerome C. Squillaro; David L. Narciso

[57] ABSTRACT

Fatigue crack growth-resistant articles are made from powder metal or cast and wrought gamma prime precipitation strengthened nickel-base superalloy material, wherein a relatively high predetermined minimum strain rate, $\dot{\epsilon}_{min}$, is employed during hot working at or near the alloy's recrystallization temperature; or alternatively a relatively high strain level, $\epsilon_{min}$, is employed during cold or warm working at temperatures below the alloy's recrystallization temperature. The worked articles are characterized by a uniform fine grain size, and grains which coarsen uniformly after heating at the supersolvus solutioning temperature, thereby alleviating non-uniform grain growth within the material.

20 Claims, 1 Drawing Sheet

METHOD FOR MAKING FATIGUE CRACK GROWTH-RESISTANT NICKEL-BASE ARTICLE

This invention relates to methods for making fatigue crack growth-resistant articles from a nickel-base superalloy, wherein the alloy is hot worked at a predetermined strain rate which is greater than or equal to a minimum strain rate, $\dot{\epsilon}_{min}$, or alternatively, cold or warm worked at temperatures below the alloy's recrystallization temperature to a predetermined strain which is greater than or equal to a minimum strain, $\epsilon_{min}$, thereby resulting in an article having a combination of high strength and tolerance to defects, for use over a temperature range of up to about 1400° F.

BACKGROUND OF THE INVENTION

The material requirements for gas turbine engines are continually being increased. Components formed from powder metal gamma prime precipitation strengthened nickel-base superalloys can provide a good balance of creep, tensile and fatigue crack growth properties to meet these performance requirements. Typically, a powder metal component is produced by some form of consolidation, such as extrusion consolidation, then isothermally forged to the desired outline, and finally heat treated. These processing steps are designed to retain a very fine grain size within the material. In order to improve the fatigue crack growth resistance and mechanical properties of these materials at elevated temperatures, these alloys are then heat treated above the gamma prime solvus temperature (generally referred to as supersolvus heat treatment), to cause significant, uniform coarsening of the grains.

However, if conventional manufacturing procedures involving hot forging operations are used to form relatively small components such as high pressure compressor blades and vanes, and fasteners, then a wide range of local strains and strain rates are introduced into the material. This results in non-uniform critical grain growth during post forging supersolvus heat treatment. Critical grain growth is defined as localized abnormal excessive grain growth to grain diameters exceeding the desired range, which is generally between about ASTM 2 and ASTM 9. (Reference throughout to ASTM grain sizes is in accordance with the standard scale established by the American Society for Testing and Materials.) More specifically, for powder metal alloys, the desired range is about 0.0006 inch (ASTM 9) to about 0.007 inch (ASTM 2); for cast and wrought alloys it is about 0.002 inch (ASTM 6) to about 0.020 inch (ASTM 00). This non-uniform critical grain growth may detrimentally affect mechanical properties such as tensile and fatigue. Therefore, large grains of this size are to be avoided, particularly within relatively small components such as high pressure compressor blades and vanes, and fasteners.

U.S. Pat. No. 4,957,567 to Krueger et al., assigned to the same assignee of the present patent application, eliminates critical grain growth in fine grain nickel-base superalloy components by controlling the localized strain rates experienced during the hot forging operations. Krueger et al. teach that, generally, local strain rates must remain below a critical value, $\dot{\epsilon}_c$, in order to avoid detrimental critical grain growth during subsequent supersolvus heat treatment. Strain rate is defined as the instantaneous rate of change of strain with time.

Accordingly, based on the teachings of Krueger et al., it was believed that in order to produce a uniform grain size after post-forging supersolvus heat treatment, the strain rate experienced during hot working must never exceed the critical value, $\dot{\epsilon}_c$. However, this is not always a practical alternative.

SUMMARY OF THE INVENTION

It is therefore an object of this invention to provide a method for making an article from a precipitation strengthened nickel-base superalloy, wherein the superalloy article is hot worked at a strain rate greater than a predetermined minimum value, $\dot{\epsilon}_{min}$, and the worked article is characterized by uniform grain growth after subsequent supersolvus heat treatment.

It is a further object of this invention that such a predetermined minimum strain rate, $\dot{\epsilon}_{min}$, be significantly higher, on the order of at least about one magnitude or greater, than the critical strain rate, $\dot{\epsilon}_c$, previously taught by Krueger et al., at which the localized strain rate was required to stay below, for avoidance of non-uniform, or critical, grain growth.

It is still a further object of this invention to provide a method for making such a nickel-base superalloy article, wherein the superalloy article is worked at a temperature less than the alloy's recrystallization temperature (i.e., either cold or warm worked, but not hot worked) to a predetermined level of strain which is greater than or equal to a minimum strain, $\epsilon_{min}$, so as to result in an article also having uniform grain growth after subsequent supersolvus heat treatment.

Lastly, it is yet an another object of this invention that such methods be adaptable for working precipitation strengthened nickel-base superalloys, having about 30–65 volume percent gamma prime content, so as to form articles which may be useful, after appropriate heat treatment, at temperatures up to about 1400° F.

It was previously thought that localized strain rates experienced during hot forging operations must remain below a critical value, $\epsilon_c$, in order to avoid undesirable non-uniform, critical grain growth during subsequent supersolvus heat treatment of these types of nickel-base superalloys. However, the method of this invention recognized that significantly higher strain rates, on the order of at least one magnitude or greater than $\epsilon_c$, may also be employed during hot working without the detrimental development of non-uniform critical grain growth within the material after supersolvus heat treatment.

Therefore, a method is provided for obtaining uniform grain growth within gamma prime precipitation strengthened nickel-base superalloys, which are provided in powder metal, or cast and wrought form, even when hot working at extremely high strain rates. This method is particularly useful for the making of relatively small components such as high pressure compressor blades and vanes, and fasteners where high localized strain rates commonly occur during the hot forging operations.

The method of this invention includes hot working the superalloy article at a predetermined temperature and strain rate, which is greater than a minimum strain rate, $\dot{\epsilon}_{min}$, to provide a worked article characterized by a uniform fine grain size, along with precipitates which include gamma prime and MC carbides. The hot working temperatures are at or near the alloy's recrystallization temperature. Next, the worked article is heated at the supersolvus solutioning temperature, so as to solution substantially all of the gamma prime precipitates but not the MC carbides, as well as to coarsen the grains uniformly. By maintaining the localized strain rates above $\epsilon_{min}$, non-uniform critical grain growth is substantially eliminated during supersolvus heat treatment.

In addition, it was determined that superalloy articles may be either cold or warm worked, at temperatures less than their recrystallization temperature, to a predetermined level of strain which is greater than or equal to a minimum strain, $\epsilon_{min}$, thereby also alleviating non-uniform critical grain growth during subsequent supersolvus heat treatment. The result is a worked article characterized by a uniform fine grain size, along with precipitates which include gamma prime and MC carbides.

When working at temperatures below the alloy's recrystallization temperature, grain growth appears to be strain dependent. This is distinguishable from hot working at elevated temperatures at or near the recrystallization temperature where grain growth is strain rate dependent.

The methods of this invention result in superalloy articles characterized by a combination of high strength and tolerance to defects, that are suitable for use over a temperature range of up to about 1400° F.

DETAILED DESCRIPTION OF THE INVENTION

Figure 1:
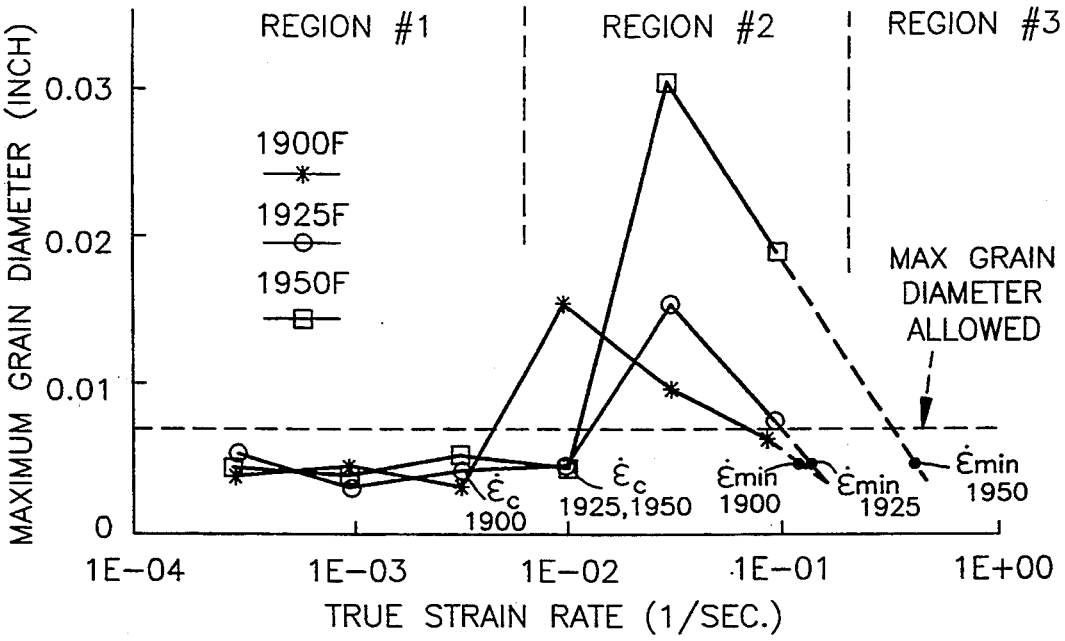
FIG. 1 is a graphical presentation showing maximum grain diameter (inches) determined after supersolvus heat treatment versus true strain rate experienced during hot working ($sec^{-1}$) for a specimen of Alloy A.

For gamma prime precipitation strengthened nickel-base superalloys, Al and Ti are the principal elements which combine with Ni to form the desired amount of gamma prime precipitate, principally $Ni_3(Al,Ti)$. The elements Ni, Cr, W, Mo and Co are the principal elements which combine to form the gamma matrix. The principal high temperature carbide formed is of the MC type, in which M is predominantly Nb, Zr and Ti. With this type of alloy, the methods of this invention provide working parameters which provide a worked structure having a grain size no larger than about ASTM 10.

It was determined that when hot working this type of alloy at elevated temperatures at or near its recrystallization temperature, grain growth is strain rate dependent, while grain growth appears to be strain dependent when cold or warm working at temperatures below the alloy's recrystallization temperature.

The strain rate experienced during hot deformation (i.e., temperatures at or near the alloy's recrystallization temperature but less than the alloy's gamma prime solvus temperature) of the superalloy material is crucial to the development of beneficial, uniform grain growth within the material during subsequent supersolvus heat treatment. As previously taught by Krueger et al., which is incorporated herein by reference, the strain rate experienced during hot deformation must remain below the relatively low critical strain rate, $\epsilon_c$, so as to avoid non-uniform critical grain growth. Alternatively, with this invention, there is provided an additional range of strain rates that are greater than a minimum strain rate value, $\epsilon_{min}$, and that are significantly greater than $\epsilon_c$, which will also avoid detrimental critical grain growth during subsequent supersolvus heat treatment.

This minimum strain rate, $\epsilon_{min}$, is significantly higher, on the order of at least a factor of ten or greater, than the previously taught critical strain rate, $\epsilon_c$, as discussed more fully later. Therefore, a range of strain rates between the much lower critical strain rate, $\epsilon_c$, and the significantly higher minimum strain rate, $\epsilon_{min}$, exists which result in detrimental non-uniform critical grain growth within the hot worked material after supersolvus heat treatment when accompanied by a sufficient amount of total strain.

The minimum strain rate, $\epsilon_{min}$, which is composition, microstructure and temperature dependent, may be determined for a selected alloy by deforming test samples under various strain rate conditions, and then heating the samples above the gamma prime solvus temperature and below the alloy's incipient melting temperature. The supersolvus solution temperature for an alloy is typically about 50° F. above its gamma prime solvus temperature. $\epsilon_{min}$ is then defined as the strain rate above which critical grain growth is not observed metallographically. The exact value of $\epsilon_{min}$ may also depend upon the amount of strain imparted into the sample at a given strain rate.

After hot working, the superalloy structure is fully solutioned, except for the high temperature carbides, at a supersolvus temperature while the worked grain structure simultaneously recrystallizes and coarsens uniformly to the desired grain size. As stated previously, for powder metal alloys, the desired range is about 0.0006 inch (ASTM 9) to about 0.007 inch (ASTM 2); for cast and wrought alloys it is about 0.002 inch (ASTM 6) to about 0.020 inch (ASTM 00). The term "uniform" with respect to grain growth means the substantial absence of non-uniform critical grain growth. The cooling rate is then appropriately controlled from the supersolvus temperature to reprecipitate gamma prime within the gamma matrix, so as to achieve the particular mechanical properties desired.

In a specific example, a gamma prime precipitation strengthened nickel-base superalloy was employed, herein called Alloy A, having a nominal composition, in weight percent, of 12–14 Co, 15–17 Cr, 3.5–4.5 Mo, 3.5–4.5 W, 1.5–2.5 Al, 3.2–4.2 Ti, 0.5–1 Nb, 0.01–0.04 B, 0.01–0.06 C, 0.01–0.06 Zr, and up to about 0.01 V, 0.3 Hf and 0.01 Y, with the balance essentially Ni and incidental impurities. The recrystallization temperature is approximately 1900° F., and the gamma prime solvus temperature is estimated to be in the range of about 2000° F.–2100° F., typically in the range of about 2025° F.–2050° F., for about 40 volume percent gamma prime. The calculated gamma prime content varied from about 33 to about 46 volume percent. The incipient melting point is estimated to be in the range of about 2200° F.–2250° F.

Although for test purposes, Alloy A was employed, the teachings of this invention are applicable to gamma prime precipitation strengthened nickel-base superalloys in general. Therefore, the teachings of this invention should not be limited to the specific composition referred to as Alloy A.

Powder metal compacts of Alloy A were produced using conventional extrusion-consolidation methods and a 6:1 reduction in area which yielded a fully dense, fine grain billet having at least about 98% theoretical density and an average grain size of about ASTM 12, with some grains as large as ASTM 10. Cylindrical specimens, about 0.4" in diameter by about 0.6" in length, were machined from the billet, and hot upset to 50% of the original length (approximately 0.7 true strain) at temperatures between about 1900° F. and about 1950° F., and strain rates between about $3\times10^{-3}sec^{-1}$ and about $1\times10^{-1}sec^{-1}$. The hot worked specimens were then supersolvus heat treated at a temperature of about 2100° F. for about one hour and air cooled to room temperature. Conventional metallographic preparation and analysis revealed a pattern of grain sizes that were dependent on the localized strain and strain rate experienced in that region. The minimum strain rate, $\epsilon_{min}$, which would produce uniform grain growth within the material, was then determined by metallographic examination.

For a deformation temperature of about 1900° F., the critical strain rate, $\epsilon_c$, was determined to be about $3\times10^{-3}sec^{-1}$, and the minimum strain rate, $\epsilon_{min}$, was determined to be about $1\times10^{-1}sec^{-1}$. For a deformation temperature of about 1925° F., the critical strain rate, $\epsilon_c$, was determined to be about $1\times10^{-2}sec^{-1}$ and the minimum strain rate, $\epsilon_{min}$, was determined to be about $2\times10^{-1}sec^{-1}$. For a deformation temperature of about 1950° F., the critical strain rate, $\epsilon_c$, was determined to be about $1\times10^{-2}sec^{-1}$, and the minimum strain rate, $\epsilon_{min}$, was determined to be about $4\times10^{-1}sec^{-1}$. For these three deformation temperatures, non-uniform critical grain growth within the powder metal compacts, defined as a grain size greater than about 0.007 inch (ASTM 2), was observed for strain rates ranging between the relatively low critical strain rate, $\epsilon_c$, and the much higher critical strain rate, $\epsilon_{min}$. As shown in FIG. 1, abnormal critical grain growth was observed in Region 2, while uniform grain growth was observed in Regions 1 and 3.

In another example, extruded billet of alloy A had been supersolvus heat treated. The extrusion process used to form the billets produced strain rates on the order of about 1 $sec^{-1}$ to about 10 $sec^{-1}$ at nominal temperatures in the range of 1850° F. to about 1925° F. These strain rates exceed the proposed $\epsilon_{min}$ for this alloy. Predictably, a substantial absence of critical grain growth in the billet material was observed.

It is believed that for hot worked superalloys, critical grain growth occurs for intermediate strain rates ranging between the relatively low $\epsilon_c$ and much higher $\epsilon_{min}$ because these superalloys, which are characterized by superplasticity at strain rates below $\epsilon_c$, produce dispersed nuclei which form critical grain growth at this intermediate strain rate. For strain rates above $\epsilon_{min}$ a large number of nuclei are produced, such that no one nucleus is able to achieve a sufficient size to continue growth, thus resulting in uniform grain growth. It was thus determined that when hot working these superalloys, the resulting grain growth during subsequent supersolvus heat treatment is strain rate dependent.

Also, similarly to the strain rates discussed above, it was determined that there exists a predetermined amount of cold or warm strain, $\epsilon_{min}$, above which, and a critical amount of cold or warm strain, $\epsilon_c$, at or below which components may be formed, that will eliminate critical grain growth during subsequent supersolvus heat treatment. The components may be formed using powder metal, or cast and wrought nickel base superalloy materials. For cold or warm working temperatures, i.e., below the alloy's recrystallization temperature and therefore below the superplastic region, the resulting grain growth observed during subsequent supersolvus heat treatment is strain dependent, rather than strain rate dependent.

In a particular example, a tapered tensile specimen of alloy A was machined and deformed in uniaxial tension at room temperature. The tensile specimen had a tapered gage section which varied from 0.25 inch at one end of the gage to 0.20 inch at the other end. Fiducial marks separated by approximately 0.010 inch were scribed on the gage section. The tensile specimen was deformed to 10% elongation nominally, and the local engineering strain along the tapered gage was calculated by dividing the change in the distance between fiducial marks after deformation by the original distance. Local strains increased from about 1% at the 0.25 inch diameter end to about 15% at the 0.20 inch diameter end. The deformed specimen was then supersolvus heat treated at 2100° F. for one hour and air cooled. The specimen was sectioned in half along the longitudinal axis and prepared for metallurgical examination. The specimen showed a wide range of grain sizes, including areas with and without critical grain growth.

Figure 2:
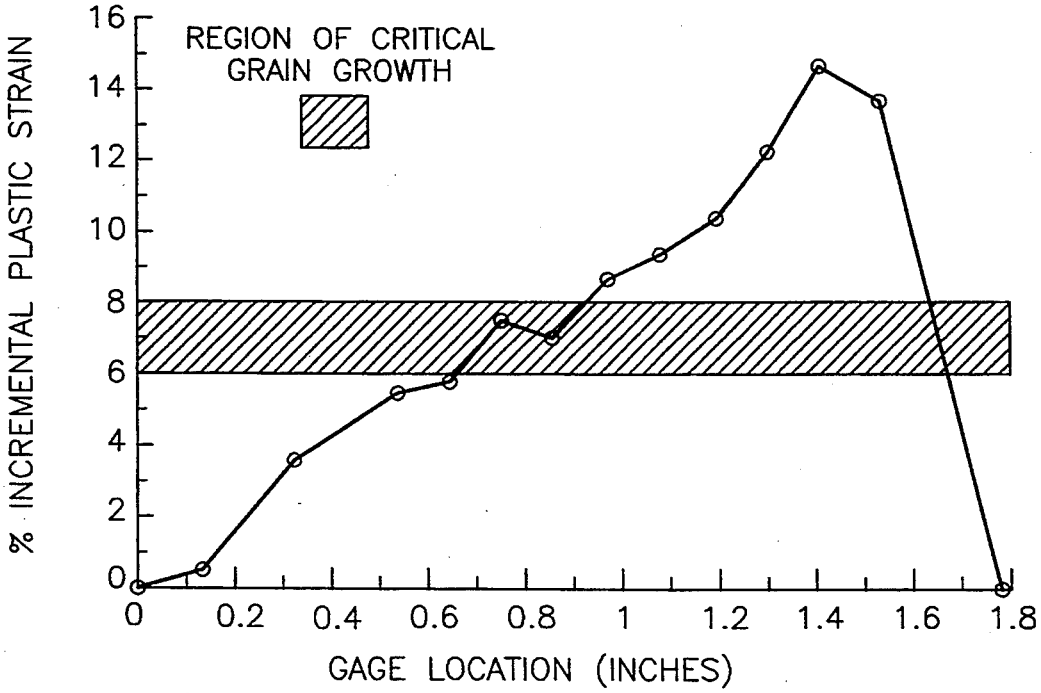
FIG. 2 is a graphical presentation showing incremental plastic strain in percent versus gage location for an Alloy A tapered tensile specimen having a nominal strain of 10 percent.

A plot of local strain, $\epsilon$, as a function of location along the gage, and the observed region of critical grain growth is shown in FIG. 2. There exists a region below about 6% strain, $\epsilon_c$, which does not exhibit critical grain growth to a size greater than about 0.007 inch (ASTM 2), and a region above about 8% strain, $\epsilon_{min}$, which also does not exhibit critical grain growth.

Since it is known that extremely low levels of strain, i.e, at or near zero percent, do not result in critical grain growth, this implies that a critical level of cold strain, $\epsilon_c$, exists which when exceeded, results in critical grain growth during subsequent supersolvus heat treatment. Yet, a higher level of strain, $\epsilon_{min}$, does not result in critical grain growth during subsequent supersolvus heat treatment. Therefore, it is concluded that there is an intermediate region between the two strain values, $\epsilon_c$ and $\epsilon_{min}$, where critical grain growth does occur.

In addition, as another example, typical manufacturing operations for fastener components, such as bolts, involve complex interactions of hot, warm and cold work. Generally, bolt manufacturing processes involve, first, hot rolling a relatively small diameter bar, about 0.25" to 1" in diameter, from a larger billet of the desired material. The relatively small diameter bar is slightly larger than or equal to the intended bolt shank diameter. After rolling, the bar is cut to a predetermined length, then typically induction heated at one end (although this is not always necessary depending on the particular alloy employed), and lastly axially upset forged to form the bolt head and wrenching features. Generally, the upset forging step, regardless of whether the material was preheated, occurs at strain rates greater than about 1.0 $sec^{-1}$. Appropriate heat treatment, thread rolling and finish machining complete the bolt manufacturing process.

In a particular example, powder compacts of Alloy A material were extruded to produce bar stock at a temperature near its recrystallization temperature. The extrusion strain was greater than $\epsilon_{min}$ and the extrusion strain rate was greater than $\epsilon_{min}$. As expected from the teachings of this invention, subsequent supersolvus solution heat treatments of samples from the bar exhibited no critical grain growth. The as-extruded bar of Alloy A was then cut to length, induction heated near the recrystallization temperature and upset forged to form a bolt. After supersolvus heat treatment of the forged bolt, critical grain growth was determined to be present in the head-to-shank transition region.

Additional as-extruded bars of Alloy A were then further cold extruded at room temperature prior to upset forging. Greater than about 15% reduction of area was introduced during the final room temperature extrusion operation. Subsequent supersolvus solution heat treatment of these cold worked bars exhibited no critical grain growth. The cold extruded bar was then cut to length and cold upset forged at room temperature. Again, no critical grain growth was observed after supersolvus heat treatment. However, in a second example using the cold extruded bar, samples were cut to length, induction heated near the recrystallization temperatures and hot upset forged. After supersolvus heat treatment, critical grain growth was present in the head-to-shank transition region of the bolts. Lastly, in a third example, the cold extruded bar was again preheated and upset forged, but the forging die was modified such that $\epsilon_{min}$ and/or $\epsilon_{min}$ were always exceeded. This was accomplished by providing a large chamfer at the head-to-shank transition region within the forging die, so that the diameter of the bolt in this transition region was tapered to increase from the shank to the bolt head. Forged bolts using the modified die did not exhibit critical grain growth after supersolvus heat treatment.

It is to be noted also, that after such processing, the article may be aged using known techniques to provide an article having a stabilized microstructure and an enhanced, attractive balance and combination of tensile, creep, stress rupture, low cycle fatigue and fatigue crack growth properties, particularly for use from ambient up to a temperature of about 1400° F. As with the heating and cooling steps described above, the aging process required for a particular material and properties would be known to one skilled in the art and is not discussed further herein. However, as an illustrative example of an aging process for the above-described gamma prime precipitation strengthened nickel-base superalloy, represented by the composition of Alloy A, the worked article would be aged at a temperature of between about 1200° F.–1600° F., particularly about 1400° F. for approximately 8 hours, followed by air cooling, so as to achieve an ultimate tensile strength of greater than about 200 ksi at 750° F. and a yield strength at 0.2% offset of greater than about 160 ksi at 750° F.

In summary, the methods of this invention for making gamma prime precipitation strengthened nickel-base superalloy articles from either powder metal, or cast and wrought material, optimize the resultant worked microstructure after the deformation/working processes by operating at or above a predetermined minimum strain rate, $\epsilon_{min}$ when hot working, or alternatively at or above a minimum strain value, $\epsilon_{min}$ when cold or warm working the material. By working the material above these values, during subsequent heat treatment at the supersolvus solutioning temperature to solution substantially all of the gamma prime precipitates but not the MC carbides, the grains are coarsened uniformly thereby substantially alleviating critical grain growth within the material.

The method of this invention is applicable to a wide range of starting input materials, including hot compacted powder, fine grain powder metal billet, coarse grain powder metal billet produced by supersolvus heat treatment of fine grain billet, as well as cast and wrought materials. In addition, the composition of the gamma prime precipitation strengthened nickel-base superalloy may vary widely so as to include alloys of this type having calculated volume fractions of gamma prime content, varying from about 30 to about 65 volume percent.

In addition, other processing techniques of high volume fraction gamma prime superalloys, besides the powder metallurgy and hot forging operations disclosed, may be employed, such as using hot isostatically pressed powder, rapidly solidified materials, or fine grain wrought materials.

The teachings of this invention are advantageous in that components, such as fasteners and high pressure compressor blades and vanes, are produced which are characterized by uniform grain size so as to have good strength, fatigue and creep resistance. By maintaining the temperature, strain rate and strain within predetermined limits, powder metal or cast and wrought superalloys may be forged and subsequently supersolvus heat treated to form uniform microstructures having the desired properties. Certainly, these teachings could be extended to other applications which require enhanced properties at temperatures ranging from ambient up to about 1400° F.

Therefore, while our invention has been described in terms of a preferred embodiment, it is apparent that other forms could be adopted by one skilled in the art, such as by substituting other gamma prime precipitation strengthened nickel-base superalloys, or by substituting other processing steps or forms of the desired materials.

Accordingly, the scope of our invention is to be limited only by the following claims.

What is claimed is:

1. A method for making an article from a gamma prime precipitation strengthened nickel-base superalloy, comprising the steps of:

providing a nickel-base superalloy having a recrystallization temperature, a gamma prime solvus temperature and an incipient melting temperature, and a calculated gamma prime content in the range of about 30 to about 65 volume percent;

working said nickel-base superalloy at preselected working conditions, including a working temperature at or near said recrystallization temperature but below said gamma prime solvus temperature, and at a strain rate greater than a predetermined minimum strain rate, $\epsilon_{min}$, to provide a worked structure having a precipitate of gamma prime, and a high temperature carbide precipitate comprising MC carbide;

heating said worked structure at a supersolvus solutioning temperature for a duration sufficient to solutionize at least a portion of the gamma prime but not the MC carbide, and to coarsen the grains within said worked structure uniformly to a desired range; and cooling said worked structure from said supersolvus solutioning temperature to room temperature at a predetermined rate so as to reprecipitate gamma prime within said worked structure.

2. The method for making an article from a gamma prime precipitation strengthened nickel-base superalloy as recited in claim 1 further comprising an aging step after said cooling step, wherein said aging step heats said worked structure to a temperature and for a duration sufficient to stabilize the microstructure of said worked structure, so as to produce an article useful for operation at elevated temperatures of up to about 1400° F.

3. The method of claim 1 wherein said working step further comprises extrusion consolidation of said nickel-base superalloy so as to produce a worked structure having at least about 98% theoretical density.

4. The method of claim 1 wherein said nickel-base superalloy is provided in consolidated powder form, and said heating step coarsens said grains uniformly to an average grain size ranging between about 0.0006 inch to about 0.007 inch.

5. The method of claim 1 wherein said nickel-base superalloy is provided in cast and wrought form, and said heating step coarsens said grains uniformly to an average grain size ranging between about 0.002 inch to about 0.020 inch.

6. The method of claim 1 wherein said superalloy consists, in weight percent, essentially of 12–14 Co, 15–17 Cr, 3.5–4.5 Mo, 3.5–4.5 W, 1.5–2.5 Al, 3.2–4.2 Ti, 0.5–1 Nb, 0.01–0.04 B, 0.01–0.06 C, 0.01–0.06 Zr, up to about 0.01 V, up to about 0.3 Hf, up to about 0.01 Y, with the balance being essentially Ni and incidental impurities.

7. The method of claim 1 wherein said predetermined minimum strain rate, $\epsilon_{min}$, is greater than a predetermined critical strain rate, $\epsilon_c$, and said working step is at a strain rate greater than said predetermined minimum strain rate such that said worked structure is characterized by a predetermined average grain size after said heating and cooling steps.

8. A method for making an article from a gamma prime precipitation strengthened nickel-base superalloy, comprising the steps of:

providing a nickel-base superalloy consisting, in weight percent, essentially of 12–14 Co, 15–17 Cr, 3.5–4.5 Mo, 3.5–4.5 W, 1.5–2.5 Al, 3.2–4.2 Ti, 0.5–1 Nb, 0.01–0.04 B, 0.01–0.06 C, 0.01–0.06 Zr, up to about 0.01 V, up to about 0.3 Hf, up to about 0.01 Y, with the balance being essentially Ni and incidental impurities and which can develop a gamma prime content in the range of about 30–46 volume percent, said superalloy having a recrystallization temperature, a gamma prime solvus temperature in the range of about 2000° F.–2100° F., and an incipient melting temperature;

working said nickel-base superalloy at preselected working conditions, including a working temperature at or near said recrystallization temperature and below said gamma prime solvus temperature, and at a strain rate greater than a predetermined minimum strain rate, $\epsilon_{min}$, which is greater than a predetermined critical strain rate, $\epsilon_c$, to provide a worked structure having a precipitate of gamma prime, and a high temperature carbide precipitate comprising MC carbide;

heating said worked structure at a supersolvus solutioning temperature for a time sufficient to solutionize at least a portion of the gamma prime but not the MC carbide, and to coarsen grains uniformly to a predetermined range;

cooling said worked structure from said supersolvus solutioning temperature to room temperature at a predetermined rate so as to reprecipitate gamma prime within said worked structure; and aging said worked structure to a temperature and for a duration sufficient to stabilize the microstructure of said worked structure, so as to produce an article useful for operation at elevated temperatures of up to about 1400° F.

9. The method for making an article from a gamma prime precipitation strengthened nickel-base superalloy of claim 8 wherein said working step further comprises extrusion consolidation of said nickel-base superalloy so as to produce a worked structure having at least about 98% theoretical density.

10. The method of claim 8 wherein said nickel-base superalloy is provided in consolidated powder form, and said heating step coarsens said grains uniformly to an average grain size ranging between about 0.0006 inch to about 0.007 inch.

11. The method of claim 8 wherein said nickel-base superalloy is provided in cast and wrought form, and said heating step coarsens said grains uniformly to an average grain size ranging between about 0.002 to about 0.020 inch.

12. A method for making an article from a gamma prime precipitation strengthened nickel-base superalloy, comprising the steps of:

providing a nickel-base superalloy having a recrystallization temperature, a gamma prime solvus temperature and an incipient melting temperature, and having a calculated gamma prime content in the range of about 30 to about 65 volume percent;

working said superalloy at preselected working conditions, including a working temperature below said recrystallization temperature, and at a strain level greater than a predetermined minimum strain level, $\epsilon_{min}$, to provide a worked structure having a precipitate of gamma prime and a high temperature carbide precipitate comprising MC carbide;

heating said worked structure at a supersolvus solutioning temperature for a duration sufficient to solutionize at least a portion of the gamma prime but not the MC carbide, and to coarsen the grains within said worked structure uniformly to a desired range; and cooling said worked structure from said supersolvus solutioning temperature to room temperature at a predetermined rate so as to reprecipitate gamma prime within said worked structure.

13. The method of claim 12 further comprising an aging step after said cooling step, wherein said aging step heats said worked structure to a temperature and for a duration sufficient to stabilize the microstructure of said worked structure, so as to produce an article useful for operation at elevated temperatures of up to about 1400° F.

14. The method of claim 12 wherein said nickel-base superalloy is provided in consolidated powder form, and said heating step coarsens said grains uniformly to an average grain size ranging between about 0.0006 inch to about 0.007 inch.

15. The method of claim 12 wherein said nickel-base superalloy is provided in cast and wrought form, and said heating step coarsens said grains uniformly to an average grain size ranging between about 0.002 inch to about 0.020 inch.

16. The method of claim 12 wherein said superalloy consists, in weight percent, essentially of 12–14 Co, 15–17 Cr, 3.5–4.5 Mo, 3.5–4.5 W, 1.5–2.5 Al, 3.2–4.2 Ti, 0.5–1 Nb, 0.01–0.04 B, 0.01–0.06 C, 0.01–0.06 Zr, up to about 0.01 V, up to about 0.3 Hf, up to about 0.01 Y, with the balance being essentially Ni and incidental impurities, said superalloy having a gamma prime solvus temperature in the range of about 2000° F.–2100° F.

17. The method of claim 12 wherein said predetermined minimum strain, $\epsilon_{min}$, is greater than a predetermined critical strain, $\epsilon_c$, and said working step is at a strain greater than said predetermined minimum strain such that said worked structure is characterized by a predetermined average grain size after said heating and cooling steps.

18. A method for making an article from a gamma prime precipitation strengthened nickel-base superalloy, comprising the steps of:

providing a nickel-base superalloy consisting, in weight percent, essentially of 12–14 Co, 15–17 Cr, 3.5–4.5 Mo, 3.5–4.5 W, 1.5–2.5 Al, 3.2–4.2 Ti, 0.5–1 Nb, 0.01–0.04 B, 0.01–0.06 C, 0.01–0.06 Zr, up to about 0.01 V, up to about 0.3 Hf, up to about 0.01 Y, with the balance being essentially Ni and incidental impurities and which can develop a gamma prime content in the range of about 30–46 volume percent, said superalloy having a recrystallization temperature, a gamma prime solvus temperature in the range of about 2000° F.–2100° F., and an incipient melting temperature, the gamma prime solvus temperature being greater than the recrystallization temperature and the incipient melting temperature being greater than the gamma prime solvus temperature;

working said nickel-base superalloy at preselected working conditions, including a working temperature below said recrystallization temperature, and at a strain level greater than a predetermined minimum strain level, $\epsilon_{min}$, to provide a worked structure having a precipitate of gamma prime, and a high temperature carbide precipitate comprising MC carbide;

heating said worked structure at a supersolvus solutioning temperature for a time sufficient to solutionize at least a portion of the gamma prime but not the MC carbide, and to coarsen grains within the worked structure uniformly to a predetermined range;

cooling said worked structure from said supersolvus solutioning temperature to room temperature at a predetermined rate so as to reprecipitate gamma prime within said worked structure; and aging said worked structure to a temperature and for a duration sufficient to stabilize the microstructure of said worked structure, so as to produce an article useful for operation at elevated temperatures of up to about 1400° F.

19. The method of claim 18 wherein said nickel-base superalloy is provided in consolidated powder form, and wherein said heating step coarsens the grains within the worked structure uniformly to an average grain size ranging between about 0.0006 inch to about 0.007 inch.

20. The method of claim 18 wherein said nickel-base superalloy is provided in cast and wrought form, and wherein said heating step coarsens the grains within the worked structure uniformly to an average grain size ranging between about 0.002 inches to about 0.020 inch.

* * * * *